US005234196A

United States Patent [19]

Harris

[11] Patent Number: 5,234,196

[45] Date of Patent: Aug. 10, 1993

[54] VARIABLE ORIFICE GAS MODULATING VALVE

[75] Inventor: James A. Harris, Greeley, Colo.

[73] Assignee: Harmony Thermal Company, Inc., Greeley, Colo.

[21] Appl. No.: 1,306

[22] Filed: Jan. 6, 1993

Related U.S. Application Data

[63] Continuation-in-part of Ser. No. 716,514, Jun. 17, 1991.

[51] Int. Cl.[5] ..... F16K 3/00

[52] U.S. Cl. ..... 251/328; 251/329; 251/332; 431/355; 126/39 R

[58] Field of Search ..... 431/355; 251/205, 326, 251/327, 328, 129.01, 129.11, 129.19, 329; 126/329, 332, 39 R; 137/15, 312

[56] References Cited

U.S. PATENT DOCUMENTS

| | | | |
|---|---|---|---|
| 1,272,263 | 7/1918 | Hooker | 251/205 |
| 1,283,907 | 11/1918 | Rigby | 251/205 X |
| 1,671,617 | 5/1928 | Spitzglass | 251/205 |
| 2,917,069 | 12/1959 | Lundy et al. | 251/205 X |
| 3,514,041 | 5/1970 | Van Rooyen | 431/355 X |
| 4,043,535 | 8/1977 | Freeman et al. | 251/329 |
| 4,283,041 | 8/1981 | Kujawski | 251/205 |
| 4,794,907 | 1/1989 | Corliss et al. | 126/39 R |
| 5,020,774 | 6/1991 | Christianson | 251/205 X |
| 5,137,261 | 8/1992 | Clifford | 251/328 |

*Primary Examiner*—Larry Jones

[57] ABSTRACT

A gas modulating valve for use with a gas burner is disclosed. Two variations of the valve are disclosed: the direct-discharge variation discharges a gas jet directly into the mixing tube of a gas burner, and the in-line variation meters the gas flow from the supply line to a gas manifold, which in turn terminates in one or more fixed orifices which discharge to the burner mixing tube or tubes. With respect to the moving parts, the two variations are identical. In both variations, the modulation of the gas flow is achieved by a thin moveable slide sandwiched in a planar space between two fixed valve body members, through which pass the upstream and downstream portions of a short gas discharge passageway. The slide has a hole which is positioned relative to the axis of the gas discharge passageway so as to produce a discharge orifice of variable size. The valve is sealed against leakage by face seals effected with o-rings. The valve actuator is a stepper motor which is controlled by an electronic controller. The valve and controller communicate through a cable, which permits them to be located any distance apart. The actuator linkage, like the sealing elements, is lubricant-free, so the valve will operate indefinitely without maintenence and over a wide temperature range.

10 Claims, 4 Drawing Sheets

VARIABLE ORIFICE GAS MODULATING VALVE

This is a continuation-in-part of Ser. No. 07/716,514, Filed Jun. 17, 1991.

BACKGROUND OF THE INVENTION

1. Field of the Invention

This invention relates to valves intended to vary or modulate the flow of gaseous fuel to a burner in response to a change in load.

2. Discussion of the Background

It is often desirable in the design of gas-fired equipment to provide a gas fuel delivery apparatus that can automatically vary the flow of gas to the burner in response to a change in load. Such a system is appropriate in many applications, including circulating boilers, water heaters, cooking equipment, gas fireplaces, radiant heaters, and forced-air furnaces. Regarding an instantaneous water heater, for example, water flows through the heat exchanger at variable rates depending on the hot water withdrawal rate at one or more remote taps. In addition to variable flow rate, the water may enter the heater at varying temperatures depending, for instance, on the season of the year. Since the intent of the heater is to deliver hot water at a specified temperature, it follows that the burner must deliver heat at a rate proportional to the flowrate through the heat exchanger and the temperature rise from inlet to outlet that accords with the desired outlet temperature. Many instantaneous water heaters incorporate a mechanism which varies the gas flowrate to the burner in response to changes in the load placed on the heater as described above.

A similar situation with regard to varying loads can pertain to hot water circulating boilers as well. In this case, the boiler is part of a circuit through which water or some other fluid is pumped. In some instances, the flowrate through the boiler can vary; for instance in a zone heating circuit served by one or more pumps. Also, a change in load can be reflected in a change in the temperature rise effected in the water passing through the boiler. In some boiler applications, it is desirable to run the boiler at various outlet temperatures, depending for instance on the outdoor temperature (space heating application) or domestic hot water draw (for the case where the boiler also heats domestic water either directly or indirectly through another heat exchanger).

For certain types of cooking equipment, it is desirable to maintain proper cooking temperature regardless of the load on the appliance. In a conveyor oven, for example, food to be cooked may be heavily or lightly loaded onto the conveyor. It is appropriate to apply automatic gas input modulation to such an appliance to maintain the proper cooking temperature at all loads without manual intervention.

Automatic modulating gas valves of different types have been used with gas-fired equipment. It is important to distinguish between automatic valves which modulate continuously over a range of inputs and automatic valves which snap from a high input to a low input when the setpoint temperature is reached, then snap back to the high input when the temperature drops a certain amount below the setpoint. Typical of valves in the latter category are the automatic input control valves used for residential gas ovens. These valves, while adequate for their application, are not modulating valves in the true sense. Further discussion herein of automatic modulating gas valves pertains only to valves of the former type, that is automatic gas valves which modulate continuously over a prescribed range of input. Other than the present invention, the three types which provide for automatic input modulation over a prescribed range of input are:

1. Immersion bulb modulating valve. This is the most common type of modulating gas valve. It is a diaphragm-actuated valve in which the diaphragm is pressurized by a fluid-filled bulb connected to the valve with a capillary tube. The bulb is immersed in the discharge of the heating appliance (generally a furnace or boiler), thereby causing the valve to modulate the gas flow in seeking the setpoint temperature. A manual adjustment of setpoint temperature is usually provided as a knob either on the valve itself or in the capillary line between the bulb and the valve. The limitations of this approach are
   1. Setpoint adjustment is manual, imprecise, and must be located in physical proximity to the valve.
   2. The range of setpoints is limited, normally to 120° F. or less. Typical is a range of 60°-100° F. Applications in commercial cooking appliances usually require capabilities for higher set points.
   3. In a system involving multiple setpoints, this approach cannot be used without a cumbersome gas train design comprising multiple parallel feed lines and control valves. This is pertinent to current commercial air heaters incorporating modulating control and developments now occuring with modulating furnaces and boilers.
2. Electronically-actuated variable regulator. The valve uses an electric coil actuator to vary the force applied to a diaphragm. There is also a mechanical means by which the minimum flow through the valve can be set. Otherwise, the valve is constructed similar to a normal gas regulator. The valve is used with an electronic controller which provides a variable current to the coil actuator. The variable current results in a correspondingly variable force against the diaphragm.
3. The third category of automatic modulating valves is a special purpose valve used on some instantaneous water heaters. This valve utilizes an immersed bulb and capillary tube, and also includes a mechanism which causes the valve to respond to a change in water flowrate through the appliance.

These three types of automatic modulating gas valves effect a variation in gas flow by modulating the pressure of the gas in the manifold to which is attached one or more fixed orifices which discharge into the mixing tube or tubes of a gas burner. Such a burner is normally a Bunsen-type atmospheric burner, but it may also be an induced-draft power burner. In the latter system, the pressure in the combustion chamber is subatmospheric due to an induced draft blower in the fluegas discharge vent. In such a system, all or most of the combustion air, along with the fuel gas, is drawn through the mixing tube of the burner. Variation of the manifold pressure may be called the first modulating method pertaining to a burner which incorporates a mixer tube. The second modulating method is to utilize a valve which effects a variable orifice through which gas is discharged directly into the mixer tube of the burner. The second method is to vary the area of the discharge orifice while keeping the pressure drop across it constant. Thus, the variation in gas flow is effected by a variable orifice area with a constant pressure drop rather than by a constant orifice area with a variable pressure drop.

Whether the first or second method of modulation is appropriate depends on the application. For a burner which is fed by multiple mixer tubes, the first method is appropriate, since one modulating valve can act to vary the pressure throughout the gas manifold. For an atmospheric burner with a single mixer tube, the second method can offer significant performance advantages over the first method (a detailed discussion of this issue may be found in the parent patent application). For an induced-draft power burner, either method may be used without a difference in operating characteristics, since the induced draft design gives the same fuel/air ratio regardless of how the gas jet is introduced into the mixer tube.

SUMMARY OF THE INVENTION

The invention disclosed herein can take on two different variations. The first variation employs the first method of modulating the gas flow to a burner incorporating one or more mixer tubes. This first variation will be called the in-line variation, since the valve is located between the gas supply line and the gas manifold. The second variation employs the second method of modulating the gas flow to a gas burner incorporating a single mixer tube. The second variation is called the direct-discharge variation, since the gas valve directs a gas jet directly into the burner mixing tube. In both variations, the moving parts and the actuator are the same. Indeed, the in-line variation can be transformed into the direct-discharge variation simply by replacing one part with two parts, as will be described in detail below. In both variations, the valve effects a variable orifice within a gas discharge passageway by means of a thin moveable slide interposed in a thin planar slide cavity between two fixed valve body members. This variable orifice acts to modulate the gas manifold pressure in the first variation, and acts to vary the discharge jet cross-sectional area in the second variation.

Another feature disclosed herein is the use of o-ring seals, which minimize gas leakage between the slide and the valve body, and which provide for lifetime lubricant-free operation. Also disclosed herein is a design for the actuating drive mechanism which is simple, effective, and inexpensive, and which also provides for lifetime lubricant-free operation. These features are improvements over the design disclosed in the parent application.

Six advantages can be cited for the invention disclosed in this specification. The first advantage is mechanical simplicity and ease of manufacture. The valve body parts are simple components which can be machined from aluminum bar stock, or die cast if desired. The other valve components are also easy to fabricate. The actuating mechanism for the moveable slide is also simple. The preferred embodiment is a stepper motor with a lead screw and drive nut assembly to move the slide up and down. The stepper motor and drive mechanism are mounted in a bonnet which in turn is mounted to the valve body. The bonnet also serves to enclose and protect the motor and drive mechanism.

The second advantage relates to the ease in which the design can embody either the first or the second variation. For both variations, the bonnet assembly, which incorporates the actuator and drive mechanism, is the same. Also, the same slide and o-ring seals are used in both variations.

The third advantage is the lubricant-free design mentioned above. The valve is virtually immune to the effects of aging, and will operate for an indefinite time without maintenance. The lubricant-free design also is effective over a wide temperature range. The valve as disclosed in this specification is rated for service over a range of −40° to +150° degrees Fahrenheit.

The fourth advantage relates to the electronic controller for the valve. The valve actuator (a stepper motor in the preferred embodiment) draws electric current only when it is necessary to move the slide. During the operational cycle of a typical application, the slide is moving only a small percentage of the time. In addition to this light duty cycle, the current that is required by the stepper motor when it is moving the slide is modest; typically about 400 mA. This low current requirement and light duty cycle have beneficial ramifications with respect to the controller design, since the electronic components which supply and condition actuator current can be relatively light-duty. This translates into lower cost and more robust operational characteristics for the controller. This contrasts with the coil-actuated valve design, in which current must be supplied to the valve actuator continuously. This continuous current requirement imposes greater design requirements on the controller electronics relative to current-carrying and heat-dissipation characteristics.

The fifth advantage also relates to the use of a stepper motor. The stepper motor is designed for high-precision positioning applications. The rotation of the drive shaft is very precise and repeatable; thus, the positioning of the slide is very precise. This precision is important in implementing feedback modulation control.

The sixth advantage is the inherent flexibility of an electronic modulation control system, of which the valve is one of two components. The other component, the electronic controller, can be located in proximity to the valve or it can be located remote from the valve, since the communication between valve and controller is through a multiconductor cable which can be made in virtually any length. Also, there is no restriction on the control algorithm (i.e. the software) which can be implemented for the modulating function. A stepper motor is inherently a digital device; it is well suited as an actuator for a digital electronic system. That is why stepper motors are used throughout the computer industry, in disk drives, printers, and other devices. The controller which will be used with the modulating valve disclosed herein is based around a digital microcontroller chip. This permits flexibility to implement whatever control code is appropriate for a given application. The hardware, i.e. the valve and controller, are the same for a multitude of applications; the software is customized for the particular requirements of each individual application. Relative to prior art, the present invention is the valve best suited as the modulating element in an electronic control system.

In addition to these six advantages, the direct-discharge variation has specific advantages which were detailed in the parent application. These advantages relate to desirable combustion characteristics for a high-turndown atmospheric gas burner.

DETAILED DESCRIPTION OF THE PREFERRED EMBODIMENT

Figure 1:
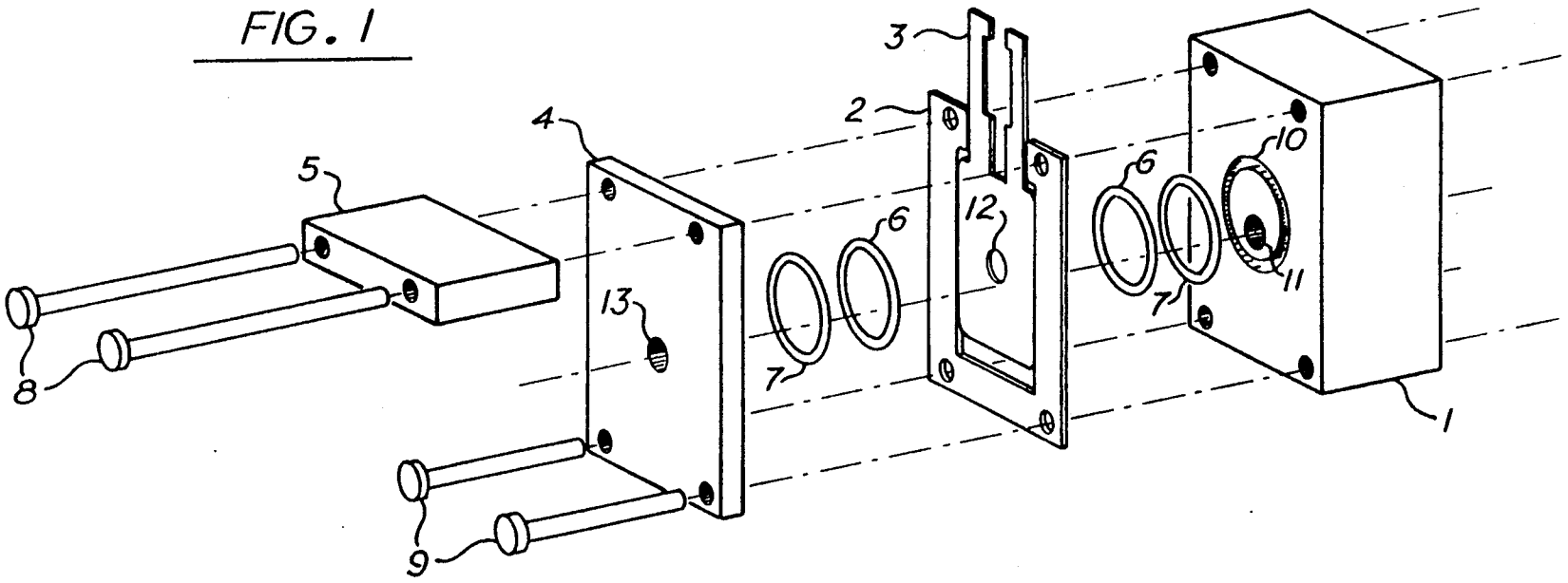
FIG. 1 shows an exploded view of the valve in the direct-discharge variation, without the bonnet assembly.
Figure 2:
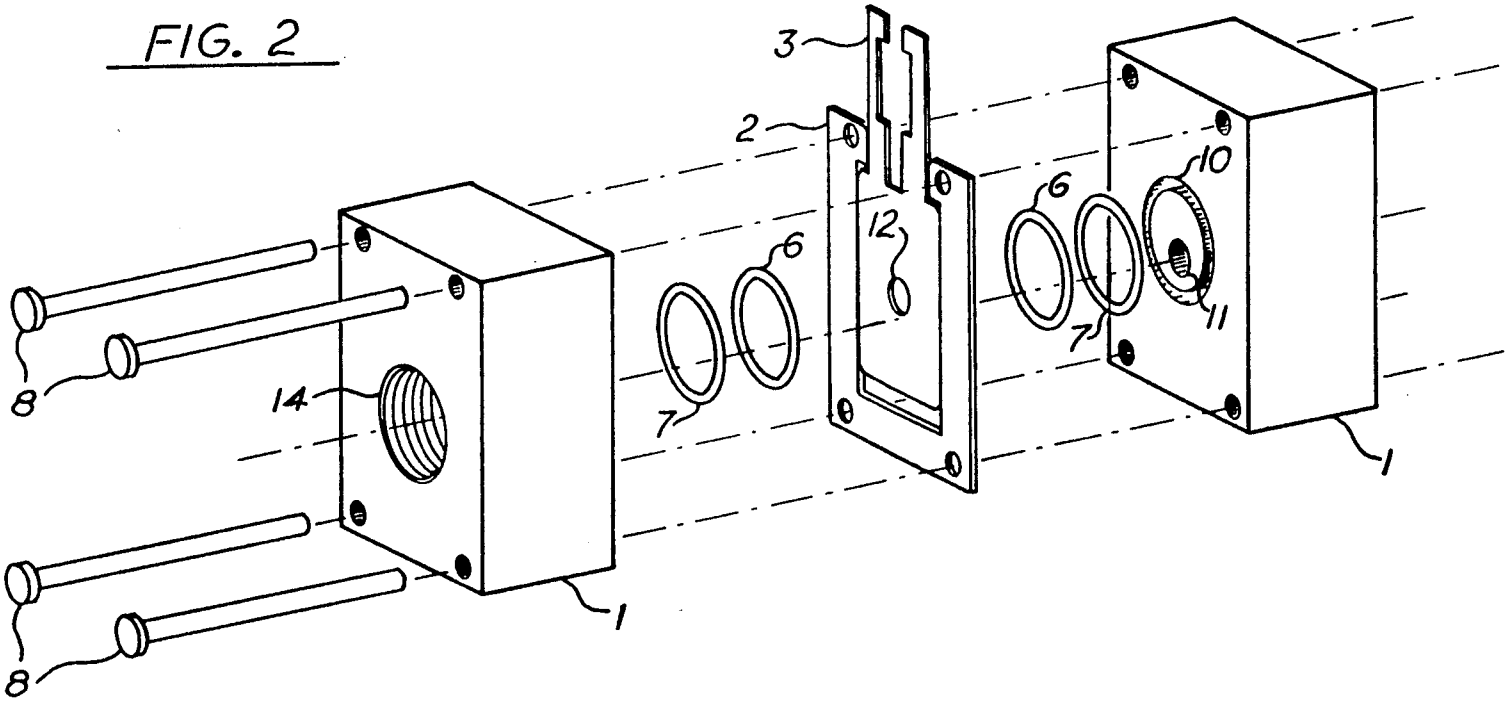
FIG. 2 shows an exploded view of the valve in the in-line variation, without the bonnet assembly.
Figure 6:
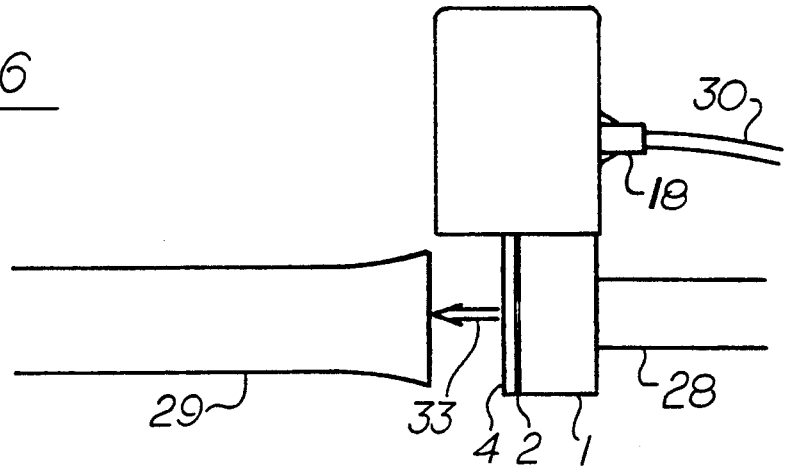
FIG. 6 shows a side external view of the gas valve in the direct-discharge variation, and its relationship to the mixing tube of a gas burner.

FIG. 1 shows an exploded view of the direct-discharge variation of the valve, without the bonnet assembly. The parts of the valve shown are the valve body 1, the keeper 2, the slide 3, the orifice plate 4, the bonnet mount spacer 5, PTFE o-rings 6, fluorosilicone o-rings 7, long assembly rivets 8, and short assembly rivets 9. On the back side of valve body 1 is a bore 14 tapped with pipe thread, as can be seen in FIG. 2. The valve body is threaded onto a gas supply line. When the supply line is pressurized, the gas flows through the valve from right to left. The bore necks down to a coaxial inlet port 11. The gas flows through inlet port 11, slide orifice 12, and outlet port 13. The gas jet issuing from the outlet port enters the mixing tube of a gas burner, as shown in FIG. 6.

Figure 8:
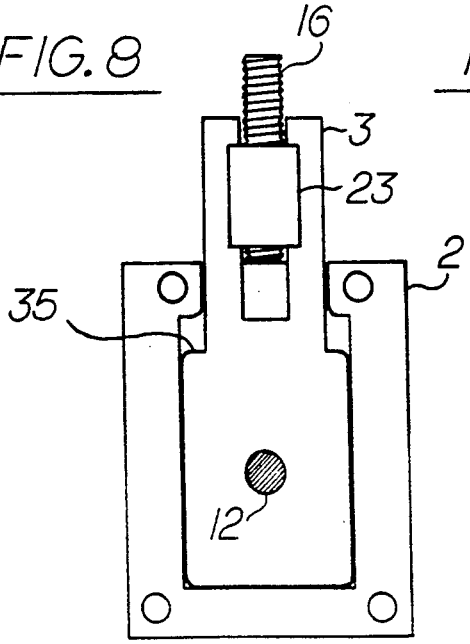
FIG. 8 shows the position of the slide when the valve is set for maximum flow.
Figure 9:
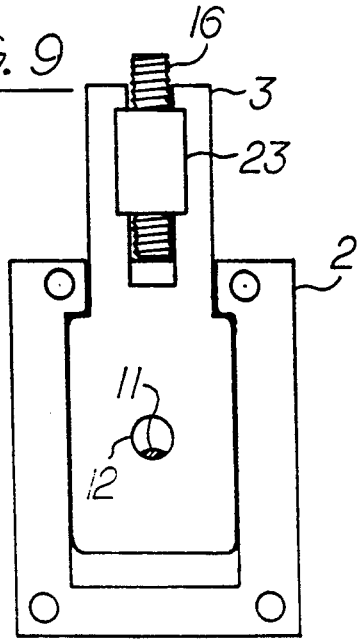
FIG. 9 shows the position of the slide when the valve is set for minimum flow.

The inlet port, slide orifice, and outlet port generally have the same diameter, although the slide orifice can be made slightly larger if desired. As indicated in FIGS. 1, 2, 8, and 9, the slide can move vertically between two extreme positions. FIG. 8 shows the slide in the bottom position, at which the valve is wide open. FIG. 9 shows the slide in the top position, at which the valve is at its minimum opening.

The o-rings act as a gas seal, minimizing gas leakage out the top of the valve past the slide. An o-ring groove 10 is cut into the interior planar surface of the valve body as shown in FIGS. 1 and 2. An identical groove is cut into the interior planar surface of the orifice plate (the surface not visible in FIG. 1). The depth of the groove is slightly less than the combined height of the two stacked o-rings. Thus, the PTFE o-ring extends slightly above the planar surface. The slide is slightly thinner than the keeper. When the assembly is sandwiched together, the PTFE o-rings are pressed against each side of the slide surface, and since the slide is slightly thinner than the keeper, the slide surface does not contact the interior planar surfaces of the valve body and orifice plate. The fluorosilicone o-ring acts as a spring loader for the PTFE o-ring in this assembly. PTFE is a rather stiff material and fluorosilicone is deformable. The enginnering dimensions are chosen so that when the assembly is sandwiched, the fluorosilicone o-rings are compressed a few thousandths of an inch. This compression results in the proper force applied to the PTFE o-rings against the slide, so as to give a good seal and yet offer minimal sliding friction.

As can be seen in FIGS. 1 and 2, the o-rings are located so as to encompass the area in which the slide orifice can be located. Placing the o-rings eccentric to the inlet and outlet ports as shown results in the minimum diameter o-rings required for a given port diameter. In order to maintain the face seal provided by the o-rings against the slide surface, the slide orifice must never be allowed to lay over a portion of the o-rings. Therefore, the largest orifice diameter that can be accomodated is slightly less than half the inside diameter of the o-rings. The largest orifice is located so that it is tangent to the center of the circle defined by the o-rings. Thus, a slide movement equal to the diameter of the orifice (which would result in a nearly closed valve) can be accomodated without having the slide orifice overlay a portion of the o-rings at any position.

The valve can be made without the o-rings, as in the parent application. There, the seal is provided by a grease lubricant in the thin gaps on either side of the slide. However, using the dual o-ring assembly with the PTFE o-rings allows for lubricant-free operation, because the dry sliding friction coefficient between PTFE and stainless steel is very low. The seal is also more positive and reliable, and there is no lubricant to dry out over time. Both PTFE and fluorosilicone are resistant to the effects of fuel gases and ozone, and retain their physical properties at high and low temperatures.

Using materials which permit lubricant-free operation results in a valve which needs no maintenence over its lifetime. Therefore, rivets 8 and 9 can be used for assembly rather than screws and nuts. The lubricant-free design extends to the actuating mechanism in the bonnet assembly, as will be discussed below.

Figure 7:
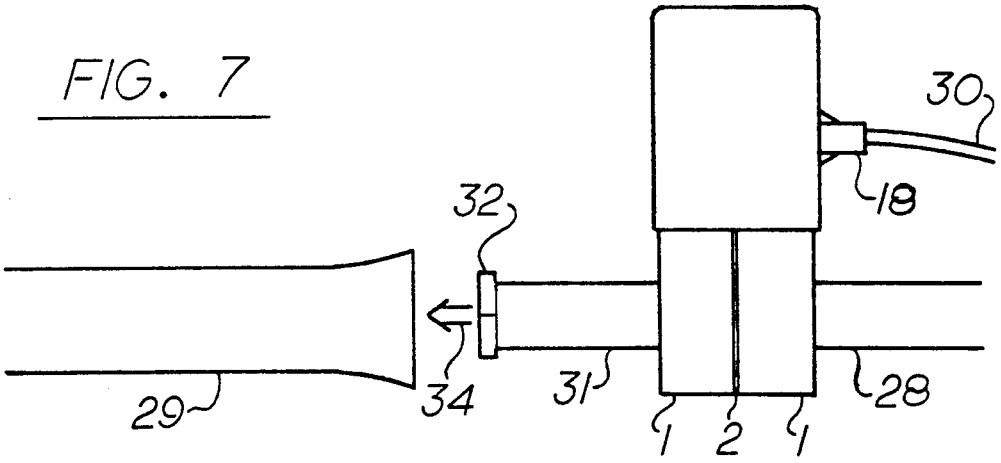
FIG. 7 shows a side external view of the gas valve in the in-line variation, and its relationship to the mixing tube of a gas burner.

FIG. 2 shows the in-line variation of the valve without the bonnet assembly. In this variation, a second valve body 1 takes the place of the orifice plate and bonnet mount spacer of the direct-discharge variation. Otherwise, the variations are identical, including the bonnet assembly. In the in-line variation, a gas manifold 31, seen in FIG. 7, is screwed into the threaded bore of the second valve body (i.e. the "outlet" valve body). This manifold terminates in one or more discharge orifice spuds 32, as indicated in FIG. 7.

Figure 3:
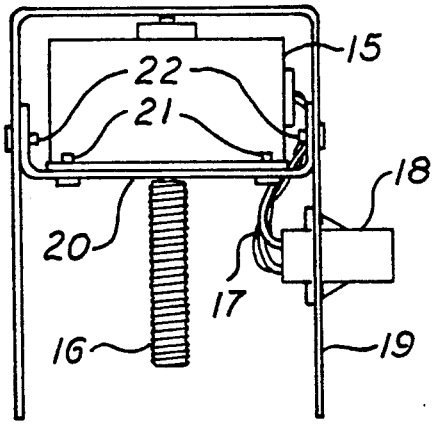
FIG. 3 shows a side view of the bonnet assembly, including the stepper motor and lead screw, with the side cover removed.
Figure 5:
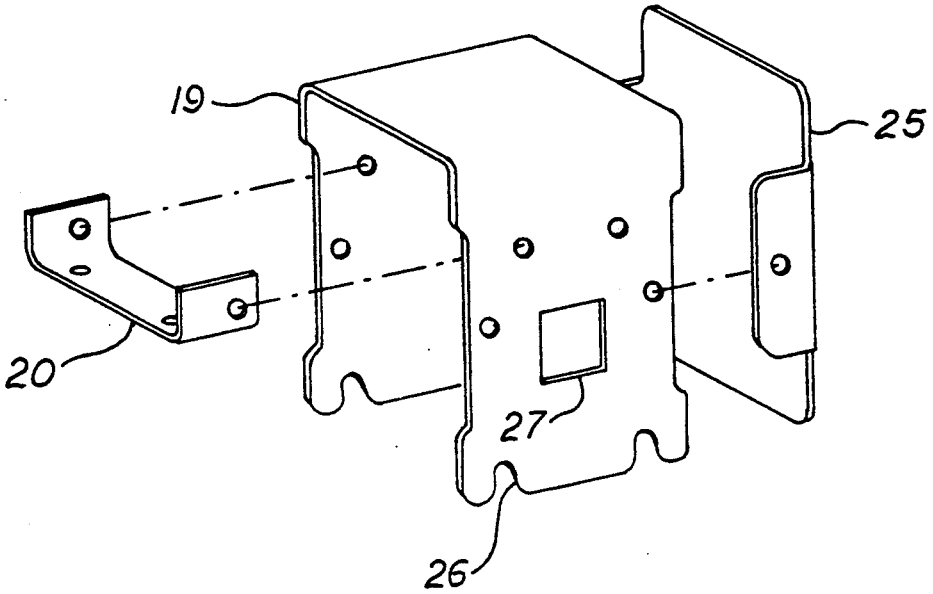
FIG. 5 shows an exploded view of the sheet metal components of the bonnet assembly.

FIG. 3 shows a side view of the bonnet assembly with the side covers 25 removed (see FIG. 5). The bonnet assembly comprises the actuating mechanism to move the slide and a sheet metal enclosure to shield the mechanism and mount it to the valve.

In the bonnet assembly are a stepper motor 15 and a lead screw 16. The lead screw is bored in one end and force-fit onto the drive shaft of the motor. The motor includes an integral mounting bracket by which the motor can be rivetted to two motor mounts 20 with rivets 21. The motor mounts are in turn rivetted to the u-bracket 19 with rivets 22. The stepper motor used here requires six lead wires 17, which are connected to a six-contact receptacle 18, which is mounted in a hole 27 in the u-bracket (seen in FIG. 5).

Figure 4:
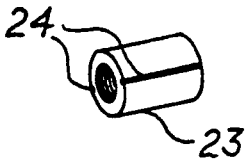
FIG. 4 shows the drive nut.

The connection between the lead screw and the slide is effected by the drive nut 23, shown in FIG. 4. The lead screw and drive nut are threaded with ¼-20 thread (although a variation on this specification could be used). The lead screw is made of stainless steel and the drive nut is made of nylon. The choice of this particular plastic as the drive nut material is made because nylon is wearresistant and low-friction, and it retains its properties over a wide temperature range. The use of a stainless steel lead screw and nylon drive nut permits lubricant-free operation of the drive mechanism.

The drive nut is a threaded tube with two longitudinal grooves 24. The grooves are slightly wider than the thickness of the slide, and the diameter of the drive nut is slightly greater than the width of the mounting slot in the slide. Thus, the drive nut "snaps" into place in the slide, resulting in the assembly indicated in FIGS. 8 and 9.

FIG. 5 shows the sheet metal components of the bonnet assembly in an exploded view. Only one of the two motor mounts 20 is shown, and only one of the two side covers 25 is shown. The side covers can be attached with either sheet metal screws or rivets. Rivets are preferred, since the valve and bonnet are designed to deliver long-term maintenence-free service, and there is no reason for field access to the drive mechanism. The four notches 26 in the u-bracket 19 are located around the upper rivets 8 to join the bonnet assembly to the body assembly; then the rivets are set in the final manufacturing operation. The bonnet mount spacer 5 in the direct discharge variation thus acts to create mount locations for the bonnet assembly which are dimensionally identical to the mount locations of the in-line variation.

A molded plastic bonnet enclosure can be used in place of the sheet metal parts 19, 20, and 25. Such a plastic enclosure would include integral mounts for the stepper motor and flat mating surfaces for positive mating to the top flat surface of the valve body. A hole or notch for the cable connector could be provided, or the motor leads could be brought out through a small notch where the bonnet enclosure mates to the valve body, and then terminated in a connector outside. This latter arrangement could offer advantages where it is desirable to provide maximum protection to the motor and drive linkage, such as installation in severe environments.

FIGS. 8 and 9 illustrate the principle of operation of the valve. Since the inlet and outlet ports are coaxial, the hatched area represents either the inlet or outlet port (although it is labelled as the inlet port in FIG. 9). It is clear that movement of the slide results in a valve orifice of variable size. It can also be seen how the slide shoulder 35 of the slide limits its vertical travel, thereby determining the minimum opening that can be effected. Therefore, it is straightforward to specify the maximum flow through the valve by drilling the appropriate port and slide orifice diameter, and to specify the minimum flow through the valve by placing the slide shoulder 35 at the appropriate location. The valve therefore places an inherent upper and lower limit on the gas flowrate, which is advantageous from the standpoint of safety. If the electronic controller malfunctions, it is impossible for the gas flowrate to be outside of operational limits, either at the upper or lower limit.

The use of a stepper motor as the actuator offers the advantages enumerated previously. Very precise positioning of the slide is possible. A stepper motor with 12 steps per revolution, used with a ¼-20 lead screw, gives a slide positioning resolution of 0.004 inch. For a slide with say 0.20 inch full travel, a resolution of 2% of full scale is achieved. Secondly, the motor draws current only when it is moving the slide. The advantage of this feature relative to the requirements imposed on the controller have already been discussed.

The disposition of the valve in a gas train is shown for the two variations in FIGS. 6 and 7. In both Figures, the valve is threaded onto a gas supply line 28, the gas jet is directed into a burner mixing tube 29, and the stepper motor is linked to the electronic controller through a six-conductor cable 30.

In FIG. 6, gas jet 33 issues directly from the outlet port in the orifice plate. In FIG. 7, the valve meters the gas flow into a gas manifold 31, which terminates in an orifice spud 32. Gas jet 34 issues from the fixed orifice in the orifice spud.

The difference in the operational characteristics between the direct-discharge and in-line variations is suggested by the gas jets 33 and 34. Assuming both valves are set to deliver an intermediate (but equal) gas flowrate to the burner, jet 34 has the full cross-sectional area of the fixed discharge orifice, and jet 33 has the smaller cross-sectional area associated with the attenuated discharge orifice of the valve. Therefore, at equal flowrates, it follows that the velocity of jet 33 is greater than the velocity of jet 34. Another way to explain this is to note that the velocity of jet 33 derives from the full pressure head in supply line 28, whereas the velocity of jet 34 derives from the diminished pressure head in the gas manifold 31. The result of this difference in jet velocities is that more primary air is drawn into the mixer tube with jet 33 than with jet 34, and this difference in the amount of primary air has a significant effect on the combustion characteristics of the burner. This difference in combustion characteristics has increasing importance as the burner is turned down. For many atmospheric burners, the direct discharge valve will permit greater turndown to be achieved consistent with acceptable combustion characteristics. However, if the burner has multiple mixing tubes, the direct-discharge configuration is impractical to implement, and the in-line configuration will generally be used.

What is claimed is:

1. An automatic gas modulating valve for regulating the flow of gaseous fuel from a fuel source to a gas burner, comprising a first valve body member having a first generally planar slide surface and a gas inlet opening communicatively connected to a gas flow conduit extending through the first valve body member and terminating in an inlet port formed in the first planar slide surface;

a second valve body member fixed to the first valve body member and including a second generally planar slide surface disposed parallel to and spaced from the first planar slide surface of the first valve body member so as to define a relatively thin planar slide cavity between the first valve body member and the second valve body member, the second valve body member having an outlet port formed in the second planar slide surface in coaxial relation to said inlet port so as to form a contiguous gas discharge passageway between the inlet port of the first valve body member and the outlet port of the second valve body member;

circular grooves cut into said first and second planar surfaces, each groove cut to a depth to accomodate two stacked o-rings such that the top portion of the top o-ring protrudes slightly above the planar surface;

a pair of o-rings set into each of said grooves, the bottom o-ring being of a deformable material and the top o-ring being of a harder material that offers a low coefficient of sliding friction against a metal surface;

a moveable slide which is slightly thinner than the width of said thin planar slide cavity, having an opening formed therein, and sandwiched within said thin planar slide cavity, such that the top o-rings of the said pairs of o-rings form face seals on the opposite sides of the slide and the bottom o-rings of the said pairs are deformed so as to provide sufficient normal force to effect the face seals, thereby minimizing gas leakage from the valve, said slide being moveable back and forth within the planar slide cavity, the opening of the slide being interposed between the inlet and outlet ports such that the sliding motion of the slide varies the position of the slide opening relative to the inlet and outlet ports so as to form a variable orifice within the gas discharge passageway, whereby the flow of gas from the source to the burner is modulated and controlled by the sliding movement of the slide;

means to constrain the movement of the slide between two extreme positions, corresponding to two sizes of said variable orifice, such that the flow of gaseous fuel is constrained to be a rate between a maximum rate and a nonzero minimum rate, whereby a flow of gas less than the minimum rate is not permitted, and a flow of gas greater than the maximum rate is not permitted, and further whereby said slide orifice is limited to positions entirely within the circle formed by the o-ring seals so that the face seals cannot be broken and gas leakage cannot occur at either of said two extreme slide positions or at any of the intermediate slide positions;

an automatic actuator which is responsive to a control signal and which is associated with the gas modulating valve for positioning the slide within the planar slide cavity at a position between said two extreme positions, whereby automatic modulating control of the gas flow may be effected; and connecting means connected between the actuator and the slide for sliding the slide back and forth in response to the actuation of the actuator.

2. The automatic gas modulating valve of claim 1 in the direct-discharge variation, in which the second valve body member comprises an orifice plate in which the outlet port is an orifice through which a gas jet discharges directly into the mixer tube of a gas burner; and a mounting member which is located against the upper portion of the orifice plate whereby the automatic actuator assemby may be mounted to the assembly comprising the first and second valve body members.

3. The automatic gas modulating valve of claim 1 in the in-line variation, in which the first and second valve body members are identical, the gas inlet opening being a threaded opening for connection to threaded gas piping, whereby the gas supply line is connected to the first valve body member and the gas manifold is connected to the second valve body member, such that the modulating action of the valve varies the pressure in the gas manifold, thereby varying the gas flowrate to a burner which is supplied from the gas manifold.

4. The automatic gas modulating valve of claim 1 in which the o-ring grooves are located eccentrically in relation to the inlet and outlet ports such that the inlet and outlet ports are entirely enclosed in one half of the circle defined by the o-ring grooves, whereby the slide opening may be moved from a position coaxial with the inlet and outlet ports to a position partially or fully within the other half of said circle, and remain fully within said circle when in any of its allowed positions.

5. The automatic gas modulating valve of claim 1 in which the slide includes an exterior portion extending above the upper surfaces of the two valve body members in all allowed positions of the slide, said portion including a cut out area for joining to the actuating means, which comprises a drive nut made of plastic which includes a threaded bore and which can be placed into the cut out area of the slide so as to be constrained from rotational or linear motion relative to the slide;

a lead screw which engages in the drive nut such that rotation of the lead screw will move the drive nut and slide in the axial direction of the lead screw;

a stepper motor whose drive shaft is engaged to the lead screw whereby the stepper motor can actuate rotation of the lead screw; and a bonnet enclosure to which the stepper motor is immovably mounted and which in turn is immovably mounted to the valve body assembly comprising the two valve body members, whereby rotational motion of the stepper motor effects the linear motion of the slide and acts thereby to modulate the flow of gas.

6. The automatic gas modulating valve of claim 1 in which the two extreme positions of the slide are established by the boundaries of the thin planar slide cavity.

7. The automatic gas modulating valve of claim 1 which further includes a thin keeper immovably sandwiched between the planar slide surfaces of the first and second valve body members, said keeper having a cutout portion so as to effect said thin planar slide cavity between the slide surfaces.

8. The automatic gas modulating valve of claim 1 which further includes a thin keeper immovably sandwiched between the planar slide surfaces of the first and second valve body members, said keeper having a cutout portion so as to effect said thin planar slide cavity between the slide surfaces and further to effect boundaries which establish the two extreme positions which limit the movement of the slide.

9. The automatic gas modulating valve of claim 1 in which said moveable slide has a shape comprising two portions, namely a first portion which is rectangular and which is constrained to locations within said slide cavity, and a second portion which is relatively narrow and which extends in part outside the valve body for connection to the automatic actuator and connecting means, such that a pair of shoulders is formed where the first portion adjoins the second portion; and in which said thin planar slide cavity is also rectangular in shape so that its two side boundaries accomodate the width of the first portion of the slide and permit slide motion in one direction only, and having an opening in the center of the top boundary to accomodate the second portion of the slide, whereby the linear motion of the slide is constrained at one end by the shoulders meeting the top boundary of the slide cavity, and is constrained at the other end by the slide meeting the bottom boundary of the slide cavity.

10. The automatic gas modulating valve of claim 1 in which said moveable slide has a shape comprising two portions, namely a first portion which is rectangular and which is constrained to locations within said slide cavity, and a second portion which is relatively narrow and which extends in part outside the valve body for connection to the automatic actuator and connecting means, such that a pair of shoulders is formed where the first portion adjoins the second portion; and which further includes a thin keeper sandwiched between the planar slide surfaces of the first and second valve body members, said keeper having a cutout portion which establishes said thin planar slide cavity, which is also rectangular in shape so that its two side boundaries accomodate the width of the first portion of the slide and permit slide motion in one direction only, and which has an opening in the center of the top boundary to accomodate the second portion of the slide, whereby the linear motion of the slide is constrained at one end by the shoulders meeting the top boundary of the slide cavity, and is constrained at the other end by the slide meeting the bottom boundary of the slide cavity.

* * * * *